US008483584B2

(12) United States Patent
Dan

(10) Patent No.: US 8,483,584 B2
(45) Date of Patent: Jul. 9, 2013

(54) IMAGE FORMING APPARATUS INCLUDING CONTROLLER FOR DETECTING AND REDUCING ABNORMAL DISCHARGES

(75) Inventor: Kenichi Dan, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 821 days.

(21) Appl. No.: 12/496,490

(22) Filed: Jul. 1, 2009

(65) Prior Publication Data

US 2010/0003042 A1 Jan. 7, 2010

(30) Foreign Application Priority Data

Jul. 1, 2008 (JP) ..... 2008172691

(51) Int. Cl.
*G03G 15/02* (2006.01)

(52) U.S. Cl.
USPC ..... 399/31; 399/50; 399/170

(58) Field of Classification Search
USPC ..... 399/31, 50, 170
See application file for complete search history.

(56) References Cited

U.S. PATENT DOCUMENTS

| | | | | |
|---|---|---|---|---|
| 4,583,836 | A * | 4/1986 | Taniguchi et al. | 399/31 |
| 7,986,889 | B2 * | 7/2011 | Hamaya | 399/31 |
| 2007/0147858 | A1 * | 6/2007 | Inukai | 399/31 |

FOREIGN PATENT DOCUMENTS

| | | | |
|---|---|---|---|
| JP | H01-077074 | A | 3/1989 |
| JP | H06-194901 | A | 7/1994 |
| JP | 08069234 | A * | 3/1996 |
| JP | H09-191647 | A | 7/1997 |
| JP | 2000-321942 | A | 11/2000 |
| JP | 2002-236435 | A | 8/2002 |
| JP | 2003-122096 | A | 4/2003 |
| JP | 2003-156977 | A | 5/2003 |
| JP | 2004-307097 | A | 11/2004 |
| JP | 2007-206554 | A | 8/2007 |

OTHER PUBLICATIONS

Japan Patent Office; Decision of Refusal in Japanese Patent Application No. 2008-172691 (counterpart to the above-captioned U.S. patent application) mailed Sep. 21, 2010.

Japan Patent Office; Notification of Reasons for Refusal in Japanese Patent Application No. 2008-172691 (counterpart to the above-captioned U.S. patent application) mailed Apr. 22, 2010.

* cited by examiner

*Primary Examiner* — Walter L Lindsay, Jr.
*Assistant Examiner* — Andrew Do
(74) *Attorney, Agent, or Firm* — Baker Botts L.L.P.

(57) ABSTRACT

An image forming apparatus includes: a photoconductor; a charging unit that charges the photoconductor; an applying unit that produces a charging voltage; a current detecting unit that detects a charging current; an image forming unit that forms an image on a recording medium; a conveying unit that conveys the recording medium; and a control unit. The control unit receives a current detecting signal; determines whether an abnormal discharge occurs during an image forming operation based on the current detecting signal; controls the applying unit to reduce a value of the charging voltage if the abnormal discharge occurs; determines whether the abnormal discharge stops occurring as a result of reducing the value of the charging voltage; and controls the conveying unit to eject the recording medium during the image forming operation if the abnormal discharge stops occurring.

1 Claim, 6 Drawing Sheets

IMAGE FORMING APPARATUS INCLUDING CONTROLLER FOR DETECTING AND REDUCING ABNORMAL DISCHARGES

CROSS-REFERENCE TO RELATED APPLICATIONS

This application claims priority from Japanese Patent Application No. 2008-172691 filed on Jul. 1, 2008, the entire contents of which are incorporated herein by reference.

TECHNICAL FIELD

The present invention relates to an image forming apparatus and more particularly to measures to be taken against an abnormal discharge in an image forming apparatus using an electrophotographic system.

BACKGROUND

In an image forming apparatus using an electrophotographic system, generally, when an abnormal discharge is caused by a charger, a load may be applied to a high voltage circuit or a load may be applied to a peripheral member if a high voltage is continuously applied to the charger. As a processing to be carried out when the abnormal discharge is caused, it is proposed to stop an operation of the image forming apparatus instantly. However, when the operation of the image forming apparatus stops during the image forming operation, a great deal of time and labor is required for removing a recording sheet such as paper.

Consequently, JP-A-2002-236435 discloses a technique for stopping an image forming operation such as a charging or developing operation when an abnormal discharge of a charger is detected and then a recording sheet is ejected by a driving operation of a driving system.

SUMMARY

According to the technique, even when the abnormal discharge is caused during the image forming operation, it is possible to eject the recording sheet without continuously applying a high voltage to the charger. However, when a sheet ejection operation is performed which an output to the charger is turned OFF, developer is likely to adhere to a photoconductor. Therefore, a large amount of the developer adhering to the photoconductor may adhere to the recording sheet with the sheet ejection operation, which increases a waste of the developer.

An object of the invention is to provide an image forming apparatus capable of suppressing a waste of developer and relieving a countermeasure to an abnormal discharge caused during an image forming operation.

According to an aspect of the invention, there is provided an image forming apparatus comprising: a photoconductor; a charging unit configured to generate a discharge so as to charge the photoconductor; an applying unit configured to produce a charging voltage for generating the discharge and apply the charging voltage to the charging unit; a current detecting unit configured to detect a charging current flowing by applying the charging voltage to the charging unit and create a current detecting signal; an image forming unit configured to form an image on a recording medium by using a developer image carried on the photoconductor which is charged; a conveying unit configured to convey the recording medium on which the image is formed; and a control unit operable to: receive the current detecting signal; determine whether an abnormal discharge occurs during an image forming operation based on the current detecting signal; control the applying unit to reduce a value of the charging voltage if it is determined that the abnormal discharge occurs; determine whether the abnormal discharge stops by reducing the value of the charging voltage; and control the conveying unit to eject the recording medium during the image forming operation if it is determined that the abnormal discharge is stopped.

DESCRIPTION

<First Exemplary Embodiment>

A first exemplary embodiment according to the invention will be described with reference to FIGS. 1 to 4.

1. General Overview of Image Forming Apparatus

Figure 1:
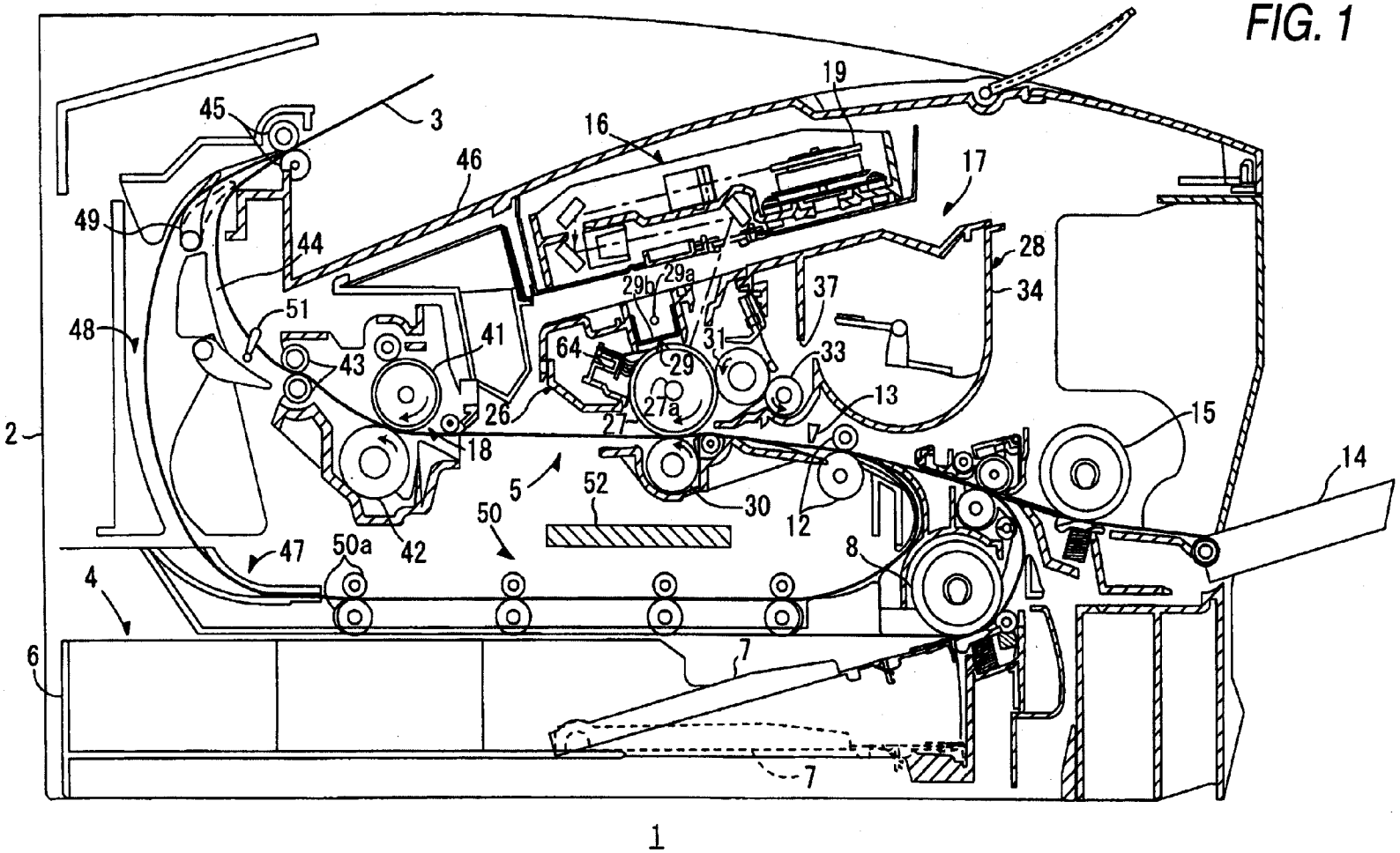
FIG. 1 is a schematically side cross-sectional view showing an internal structure of a laser printer according to a first exemplary embodiment of the invention.

FIG. 1 is a side cross-sectional view showing a laser printer according to a first exemplary embodiment. The laser printer is an example of an image forming apparatus. In FIG. 1, a laser printer 1 includes a feeder unit 4 configured to feed a recording sheet 3 (an example of a "recording medium") and an image forming unit 5 configured to form an image on the sheet 3 fed by the feeder unit 4. The feeder unit 4 and the image forming unit 5 are provided in a body frame 2 functioning as a main body of the image forming apparatus. The image forming apparatus is not limited to the laser printer but may be any image forming apparatus such as an LED printer or a multifunction device having a copying function and a facsimile function, for example.

(1) Feeder Unit

The feeder unit 4 includes: a feeding tray 6 which is detachably attached to a bottom portion of the body frame 2; a pressing plate 7 provided in the feeding tray 6; a feeding roller 8 provided above an end portion on one end side of the feeding tray 6 (one end side (a right side of the paper in FIG. 1) and an opposite side thereto (a left side of the paper in FIG. 1) will be hereinafter referred to as front and rear sides respectively), and a registration roller 12 provided on a downstream side in a conveying direction of the recording sheet 3 with respect to the feeding roller 8. A post-registration sensor 13 is provided in the vicinity of a downstream side of the registration roller 12 in a conveying direction. The post-registration sensor 13 is configured to detect a leading end of the recording sheet 3 and create a detecting signal indicating a detection timing. The detecting signal is supplied to a CPU 61 and is used as a reference timing relating to an image formation processing.

The recording sheets 3 placed on the pressing plate 7 are pressed toward the feeding roller 8 from a back side of the pressing plate 7 by means of a spring (not shown), and an upper most sheet of the recording sheets 3 is fed one by one by a rotation of the feeding roller 8. The recording sheet 3 thus fed is fed to the registration roller 12. The registration roller 12 includes a pair of rollers, and the recording sheet 3 is fed to an image forming position X (see FIG. 4) after the registration of the recording sheet 3. The image forming position X is a transfer position in which a toner image formed on a photoconductor drum 27 is transferred to the recording sheet 3. In the exemplary embodiment, the image forming position X is defined as a position at which the photoconductor drum 27 and a transfer roller 30 contact each other.

The feeder unit 4 further includes a multipurpose tray 14 and a multipurpose feeding roller 15 configured to feed a recording sheet 3 (which is manually fed) placed on the multipurpose tray 14.

(2) Image Forming Unit

The image forming unit 5 includes a scanner unit 16, a process cartridge 17 and a fixing unit 18.

(a) Scanner Unit

The scanner unit 16 is provided on an upper portion in the body frame 2. The scanner unit 16 includes a laser beam emitting unit (not shown), a polygon mirror 19 which can be rotatably driven, a plurality of lenses and a plurality of reflecting mirrors. A laser beam based on image data is emitted from the laser beam emitting unit, and the laser beam is irradiated by high speed scanning over a surface of the photoconductor drum 27 in the process cartridge 17 through the polygon mirror 19, the lenses and the reflecting mirrors as shown in a chain line in FIG. 1.

(b) Process Cartridge

The process cartridge 17 is provided below the scanner unit 16. The process cartridge 17 includes a drum cartridge 26 which is detachably attached to the body frame 2, and a developer cartridge 28 stored in the drum cartridge 26.

The developer cartridge 28 is removably stored in the drum cartridge 26. The developer cartridge 28 includes a developing roller 31, a supplying roller 33 and a toner hopper 34. In the toner hopper 34, developer such as positively chargeable toner is accommodated.

The toner in the toner hopper 34 is supplied from a toner supplying port 37 opened on a rear side portion of the toner hopper 34. The supplying roller 33 is rotatably provided in a rear position of the toner supplying port 37. The developing roller 31 is rotatably provided opposing the supplying roller 33. When a developing operation is performed, a given or predetermined developing bias voltage is applied to the developing roller 31 by a bias applying circuit 60 (see FIG. 2) mounted on a high voltage power circuit board 52. The toner supplied from the toner supplying port 37 is supplied to the developing roller 31 by a rotation of the supplying roller 33. At this time, the toner is frictionally charged to be positive between the supplying roller 33 and the developing roller 31.

The drum cartridge 26 includes the photoconductor drum 27 (an example of a "photoconductor" and a "conveying unit"), a charger 29 (an example of a "charging unit") and the transfer roller 30.

The photoconductor drum 27 is disposed to oppose the developing roller 31 on the rear side of the developing roller 31 and is supported rotatably in a direction of an arrow (a clockwise direction in FIG. 1) in the drum cartridge 26. The photoconductor drum 27 includes: a cylindrical drum body; and a metallic drum shaft 27*a* which supports the drum body and which is provided on a shaft center of the drum body. A positive charging photoconductor layer is formed on a surface of the drum body.

The charger 29 is disposed above the photoconductor drum 27 to oppose the photoconductor drum 27 at a given or predetermined interval so as not to contact the photoconductor drum 27 and is supported on the drum cartridge 26. The charger 29 is, for example, a scorotron charger including a charging wire 29*a* and a grid 29*b*. The charger 29 generates a corona discharge from the charging wire 29*a* and uniformly charges a surface of the photoconductor drum 27 to have a positive polarity. A charging voltage Vcg is applied from the bias applying circuit 60 (an example of a charging signal generating unit) to the charging wire 29*a*.

The surface of the photoconductor drum 27 is first charged positively and uniformly by the charger 29 with a rotation of the photoconductor drum 27 and is then exposed by high speed scanning of the laser beam emitted from the scanner unit 16. Accordingly, an electrostatic latent image based on image data is formed on the surface of the photoconductor drum 27.

When the toner carried on a surface of the developing roller 31 and positively charged opposes and contacts the photoconductor drum 27 by a rotation of the developing roller 31, the toner is supplied to the electrostatic latent image and selectively carried on the surface of the photoconductor drum 27. Accordingly, the image is visualize on the photoconductor drum to thereby achieve development.

The transfer roller 30 (an example of the a "conveying unit") is disposed opposing the photoconductor drum 27 below the photoconductor drum 27 and is supported on the drum cartridge 26 rotatably in a direction of an arrow (a counterclockwise direction in FIG. 1). A given or predetermined transfer bias voltage is applied from the bias applying circuit 60 to the transfer roller 30 in a transfer operation, and the developed electrostatic latent image is transferred to the recording sheet 3.

(c) Fixing Unit

As shown in FIG. 1, the fixing unit 18 is provided on a rear and downstream side of the process cartridge 17. The fixing unit 18 includes a heating roller 41 (an example of the a "conveying unit"), a pressing roller 42 configured to pressing the heating roller 41 (an example of the "conveying unit") and a pair of conveying rollers 43 (an example of the "conveying unit") provided on a downstream side of the heating roller 41 and the pressing roller 42. The heating roller 41 includes a halogen lamp formed of a metal and configured to perform heating. The heating roller 41 is driven to rotate in a direction of an arrow (a clockwise direction) by inputting a power from a motor (not shown).

The pressing roller 42 is driven by the heating roller 41 to rotate in the direction of the arrow (the counterclockwise direction in FIG. 1) with the heating roller 41 pressed. In the fixing unit 18, the toner transferred to the recording sheet 3 in the process cartridge 17 is thermally fixed while the recording sheet 3 passes between the heating roller 41 and the pressing roller 42. The recording sheet 3 is then conveyed to an ejection path 44 by means of the conveying roller 43. The recording sheet 3 conveyed to the ejection path 44 is conveyed to an ejection roller 45 (an example of the "conveying unit") and is ejected on an output tray 46 by means of the ejection roller 45.

The laser printer further includes an inversion conveying unit 47 in order to form images on both sides of the recording sheet 3. The inversion conveying unit 47 includes the ejection roller 45, an inversion conveying path 48, a flapper 49 and a plurality of inversion conveying rollers 50 (an example of the "conveying unit"). When printing is carried out on the both sides of the recording sheet 3, the recording sheet 3 having an image formed on a front surface thereof is conveyed to the ejection roller 45 through a normal conveying path, and then the ejection roller 45 is driven to rotate reversely so as to convey the recording sheet 3 to the registration roller 12 through the flapper 49, the inversion conveying path 48 and the inversion conveying roller 50. Accordingly, sides of the recording sheet 3 are inverted and thereby to carry out the printing on the back face of the recording sheet 3. As shown in FIG. 1, any of the inversion conveying rollers which is closest to the ejection roller 45 will be hereinafter referred to as a first inversion conveying roller 50*a*.

2. Charging Control

Figure 2:
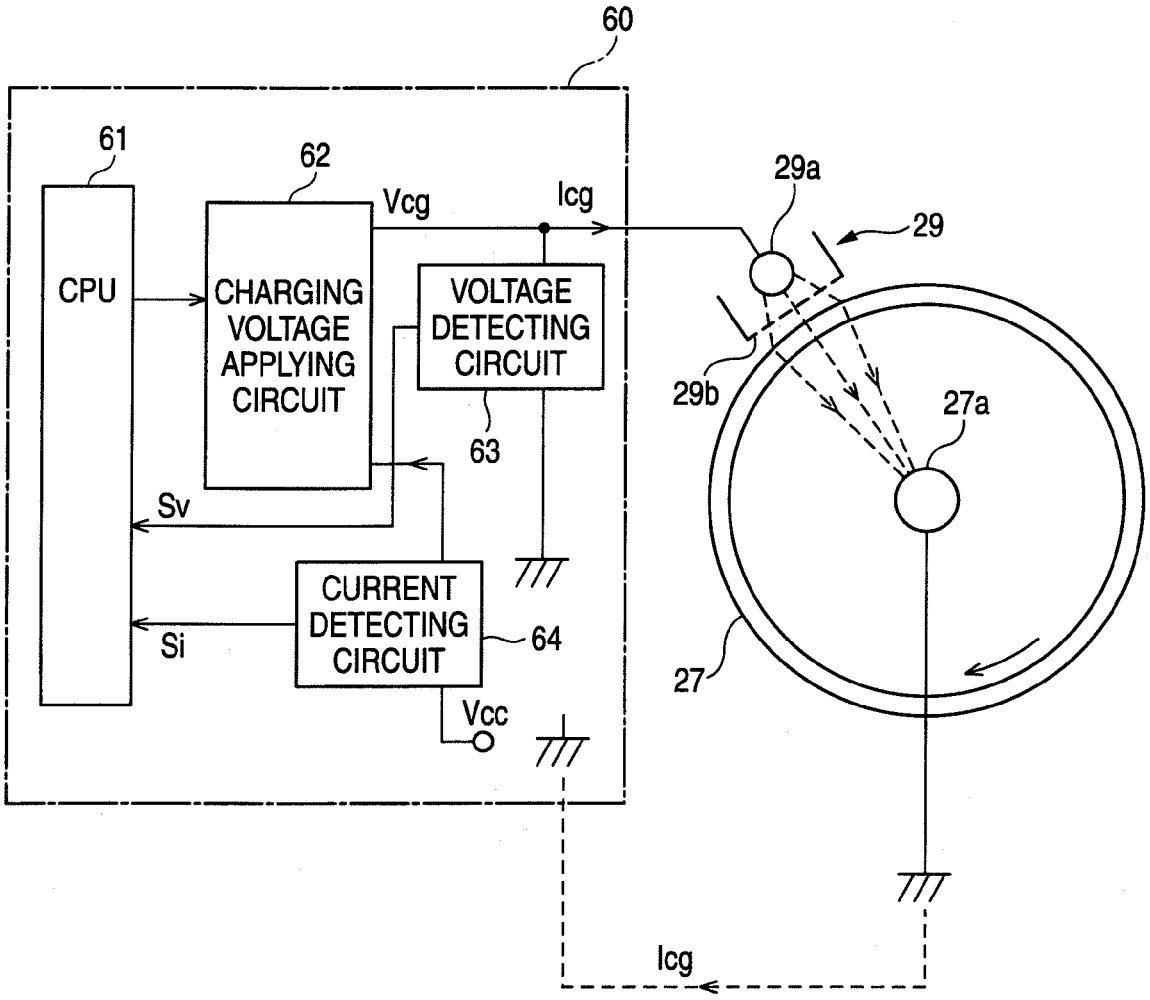
FIG. 2 is a block diagram schematically showing a circuit structure relating to a charging control.

FIG. 2 is a block diagram schematically showing a circuit structure relating to a charging control for the charger 29. The photoconductor drum 27 is charged by applying a high voltage, for example, the charging voltage Vcg of 5.5 kV to 8 kV to the charging wire 29*a* of the charger 29 through the bias applying circuit 60 and generating a corona discharge over the surface of the photoconductor drum 27 through the grid 29*b* of the charger 29.

The bias applying circuit 60 produces bias voltages to be applied to the transfer roller 30, the developing roller 31 and the charging wire 29*a* of the scorotron charger 29, respectively. FIG. 2 shows only a structure relating to the charging bias voltage Vcg for the purpose of the description.

The bias applying circuit 60 includes the CPU 61 (an example of a "control unit"), a charging voltage applying circuit 62 (an example of an "applying unit"), a charging voltage detecting circuit 63, and a charging current detecting circuit 64 (an example of a "current detecting unit").

The charging voltage applying circuit 62 includes, for example, a PWM signal smoothing circuit, a boosting transformer and a smoothing rectifying circuit The charging voltage applying circuit 62 is constant-current controlled by a Pulse Width Modulation (PWM) signal sent from the CPU 61. More specifically, the CPU 61 controls the charging voltage Vcg through the charging voltage applying circuit 62 such that a charging current Icg is constant.

The charging voltage detecting circuit 63 includes a voltage dividing resistor, for example, and divides the charging voltage Vcg so as to create a charging voltage detecting signal Sv. The charging voltage detecting circuit 63 supplies the charging voltage detecting signal Sv to the CPU 61. The charging voltage detecting circuit 63 may rectify a voltage on a primary side of the boosting transformer, thereby to create the charging voltage detecting signal Sv.

The charging current detecting circuit 64 includes, for example, a resistor connected between a secondary winding of the boosting transformer of the charging voltage applying circuit 62 and a source voltage Vcc. The charging current detecting circuit 64 creates a charging current detecting signal (voltage signal) Si at one end (terminal) closer to the secondary winding side of the resistor and supplies the charging current detecting signal Si to the CPU 61. In this case, the charging current Icg flows from the source voltage Vcc via the charging current detecting circuit 64, the secondary winding of the boosting transformer, the charger 29 and the photoconductor drum 27 and is returned to the bias applying circuit 60 through a common ground. In that case, the source voltage Vcc is divided by the charging current detecting circuit (resistor) 64 and a load resistor (a discharging path and the photoconductor drum 27). More specifically, the charging current Icg is detected as a voltage dividing value of the source voltage Vcc in the charging current detecting circuit 64.

The CPU 61 receives the charging current detecting signal (a feedback signal) Si and controls the charging voltage applying circuit 62 such that the charging current detecting signal Si has a set value (which may be predetermined), thereby to constant-current control the charging current Icg in a normal charging control.

On the other hand, when an abnormal discharge occurs between the charger 29 and the photoconductor drum 27 during charging control, the charging current Icg is increased more greatly than that in a normal discharge. Therefore, the value of the charging current detecting signal Si is different from that in a normal state. For this reason, the CPU 61 determines whether the abnormal discharge occurs based on a change in the charging current detecting signal Si. More specifically, when the abnormal discharge occurs, a resistance value of the discharging path is decreased. Consequently, the voltage dividing value of the source voltage Vcc, that is, the value of the charging current detecting signal Si is decreased. Accordingly, if the value (voltage value) of the charging current detecting signal Si is equal to or smaller than a reference value (which may be predetermined), the CPU 61 determines that the charging current Icg has a given or predetermined value or more and the abnormal discharge thus occurs.

The CPU 61 receives the charging voltage detecting signal Sv and monitors whether the desirable charging voltage Vcg is produced by the charging voltage applying circuit 62 based on the charging voltage detecting signal Sv. The CPU 61 controls, in addition to the bias applying circuit 60, a processing relating to an image formation.

3. Sheet Ejection Processing in Abnormal Discharge

Figure 3:
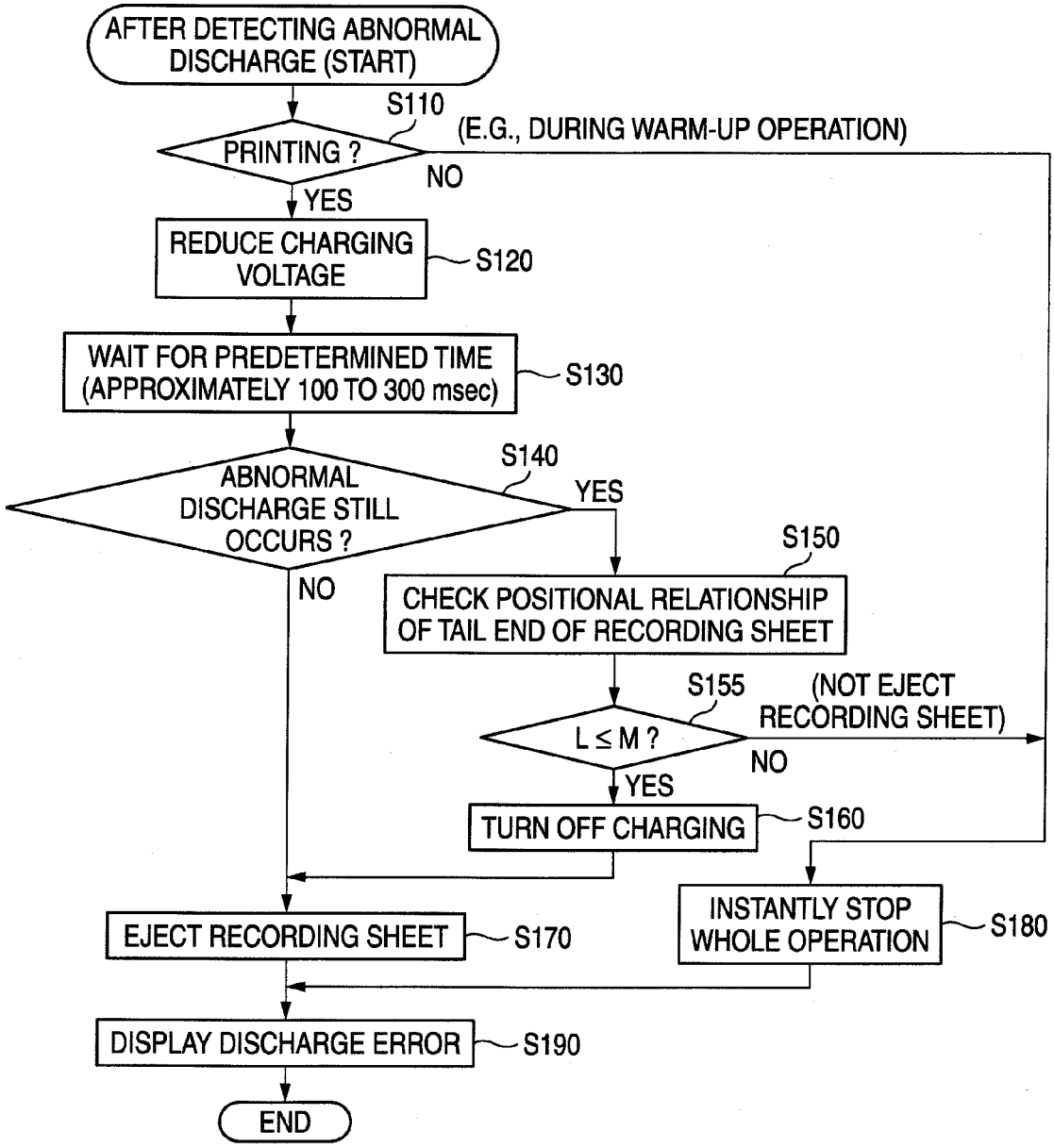
FIG. 3 is a flowchart showing a processing relating to a sheet ejection at an abnormal discharge according to the first exemplary embodiment.
Figure 4:
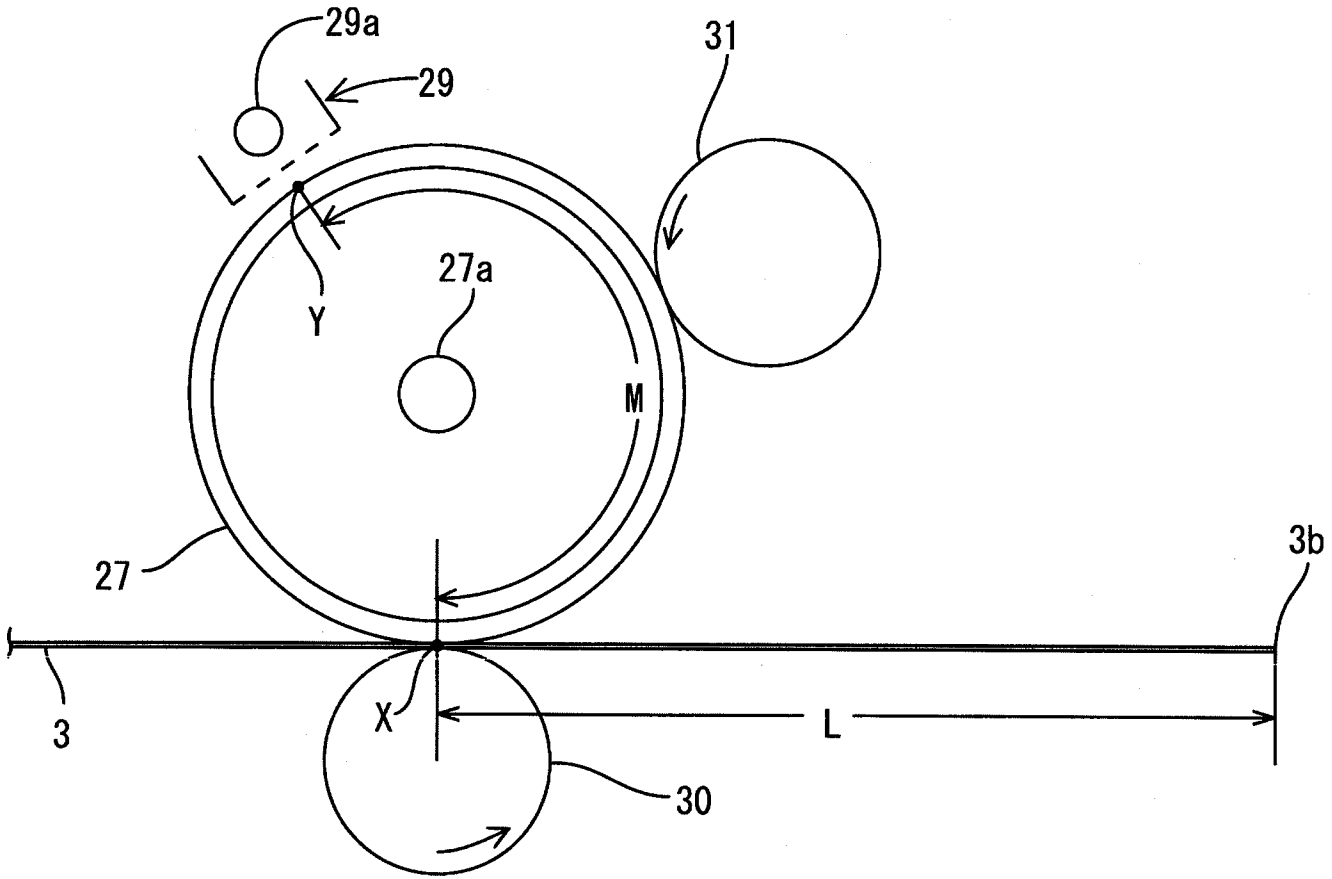
FIG. 4 is an explanatory view showing a positional relationship between a tail end of a recording sheet and a charger.

Next, a sheet ejection processing in an abnormal discharge according to the first exemplary embodiment will be described with reference to FIGS. 3 and 4. FIG. 3 is a flowchart showing a processing relating to a sheet ejection in the abnormal discharge which is to be executed by the CPU 61 in accordance with a predetermined program. The flowchart in FIG. 3 shows a processing to be carried out after the abnormal discharge in the charger 29 is detected by the CPU 61 based on the value of the charging current detecting signal Si as described above. FIG. 4 is an explanatory view showing a positional relationship between a tail end 3*b* of the recording sheet 3 and the charger 29.

At a step S110 in FIG. 3, the CPU 61 determines whether printing is being carried out on the recording sheet 3 in the occurrence of the abnormal discharge. If the printing is not being carried out, for example, during a warm-up operation, the operation of the laser printer 1 is stopped instantly at a step S180. At a step S190, then, a discharge error is indicted, for example, by displaying an error massage on a display device of an operation panel. For example, the error massage "A drum cartridge is dirty. Clean a charging wire." is displayed to promote a user to clean the charging wire.

On the other hand, if it is determined that the printing is being carried out on the recording sheet 3 at the step S110, the charging voltage applying circuit 62 is controlled to reduce the value of the charging voltage Vcg to be a set voltage (which may be predetermined) at a step S120. The charging voltage Vcg is reduced to the voltage which allows developer not to adhere to unexposed regions of the photoconductor 27. Accordingly, unnecessary developer is not put on the recording sheet 3. After the value of the charging voltage Vcg is reduced to the set voltage, a standby is performed for a given time period, for example, 100 msec to 300 msec at a step S130. Incidentally, rollers of the conveying system are still in operation during the standby. Whether the value of the charging voltage Vcg is reduced to the set voltage is determined based on the charging voltage detecting signal Sv.

At a step S140, next, the CPU 61 determines whether the abnormal discharge still occurs also after the reduction in the charging voltage Vcg and a passage of the standby time period. The determination is made based on the charging current detecting signal Si. If it is determined that the occurrence of the abnormal discharge is stopped, the recording sheet 3 during the printing operation is ejected on the output tray 46 at a step S170 and the discharge error is displayed at the step S190.

On the other hand, if it is determined that the abnormal discharge still occurs at the Step S140, a positional relationship of the tail end 3*b* of the recording sheet 3 is checked at a step S150. More specifically, as shown in FIG. 4, a length L from the image forming position X to the tail end 3*b* of the recording sheet 3 is calculated. The length L is calculated as follows:

$$L=d-v(t1-t0)$$

where a conveying speed of the recording sheet 3 is represented as v which is assumed to be set constant, a time that the post-registration sensor 13 detects the tail end 3*b* of the recording sheet 3 is represented by t0, a time that it is determined that the abnormal discharge still occurs at the step S140 is represented by t1, and a distance from the post-registration sensor 13 to the image forming position X is represented by d.

The distance d from the post-registration sensor 13 to the image forming position X is set to be greater than a length M (see FIG. 4) in a rotating direction from a position Y opposing the charger 29 on the circumference of the photoconductor drum 27 to the image forming position X.

At a step S155, it is determined whether the length L is equal to or smaller than the length M. If the length L is equal to or smaller than the length M, the CPU 61 turns OFF the production of the charging voltage Vcg at a step S160 and conveys the recording sheet 3 during the image formation through the photoconductor drum 27, the transfer roller 30, the fixing unit 18 and the ejection roller 45 and ejects the recording sheet 3 on the output tray 46 at the step S170. The reason is as follows. When the length L is equal to or smaller than the length M, even if the operation for charging the photoconductor drum 27 through the charger 29 is turned OFF, a current position of the recording sheet 3 is located at a position in which the tail end 3*b* of the recording sheet 3 will have already passed through the transfer position X when the toner supplied to a non-charged portion of the photoconductor drum 27 from the developing roller 31 reaches the transfer position X. That is, in this case, the toner is not consumed in an unnecessary amount for the recording sheet 3 even if the operation for conveying the recording sheet 3 and ejecting the recording sheet 3 to the output tray 46 is carried out.

On the other hand, if it is determined that the length L is larger than the length M at the step S155, the toner supplied from the developing roller 31 to the non-charged portion in the photoconductor drum 27 may be excessively put on the recording sheet 3. Therefore, the ejection of the recording sheet 3 is not performed and processings after the step S180 are executed.

4. Advantages of First Exemplary Embodiment

In the first exemplary embodiment, when the abnormal discharge occurs during the image forming operation, the value of the charging voltage Vcg is reduced such that the developer does not adhere to the exposed region of the photoconductor drum 27, that is, an unnecessary developer is not put on the recording sheet 3. For this reason, when the occurrence of the abnormal discharge is stopped by a reduction in the charging voltage Vcg, the recording sheet 3 is ejected without causing a large amount of the developer adhering to the recording sheet 3. Therefore, even when the abnormal discharge occurs during the image forming operation, it is possible to suppress the waste of the developer and to reduce a time and labor for removing the recording sheet 3 remaining in the laser printer 1. Thus, it is possible to relieve a countermeasure against the abnormal discharge.

Further, when the occurrence of the abnormal discharge is not stopped even reducing the value of the charging voltage Vcg, the recording sheet 3 during the image formation is ejected when the length L from the image forming position X to the tail end 3*b* of the recording sheet 3 is equal to or smaller than the amount M. Therefore, even when the occurrence of the abnormal discharge is not stopped, therefore, it is possible to suitably eject the recording sheet 3 during the image formation without causing a large amount of the unintended developer to adhere to the recording sheet 3.

<Second Exemplary Embodiment>

Figure 5:
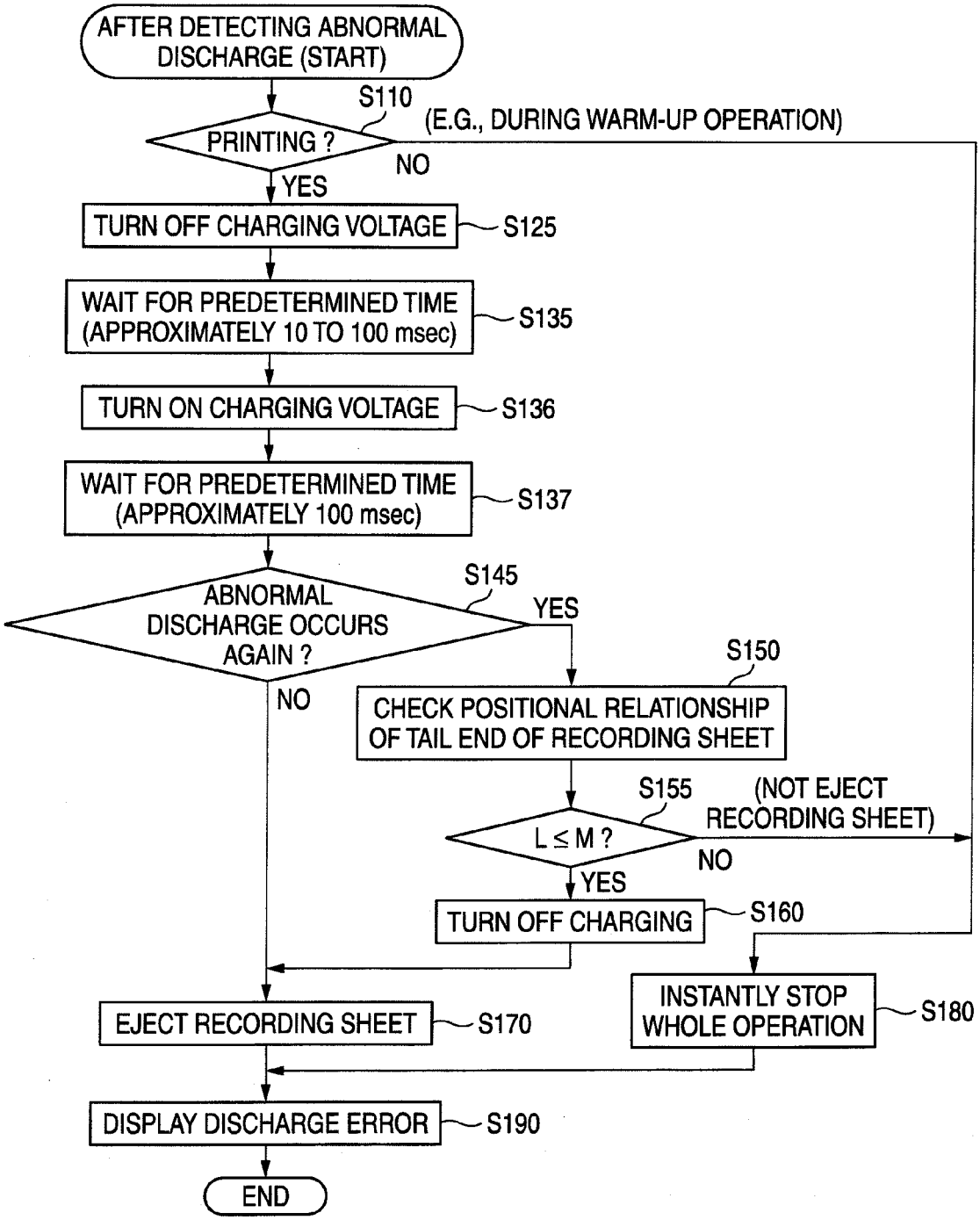
FIG. 5 is a flowchart showing a processing relating to a sheet ejection at an abnormal discharge according to a second exemplary embodiment.

Next, a second exemplary embodiment according to the invention will be described with reference to FIG. 5. FIG. 5 is a flowchart showing a processing relating to a sheet ejection in an abnormal discharge according to the second exemplary embodiment. The flowchart of FIG. 5 shows processings to be executed after the abnormal discharge in a charger 29 is detected by a CPU 61 based on a value of a charging current detecting signal Si in the same manner as in FIG. 3.

Mechanical and electrical structures according to the second exemplary embodiment are substantially identical to those according to the first exemplary embodiment, and only a processing relating to a sheet ejection in the abnormal discharge is different from that in the first exemplary embodiment. In FIG. 5, the same processings as those shown in FIG. 3 is indicated by the same step numbers and description thereof will be omitted, and only differences will be described.

In the second exemplary embodiment, if it is determined that printing is being carried out on a recording sheet 3 at a step S10, the CPU 61 controls a charging voltage applying circuit 62 to stop a production of a charging voltage Vcg and once turns OFF an application of the charging voltage Vcg to the charger 29 in order to stop the abnormal discharge at a step S125. At a step 135, a standby is carried out for a time period, for example, 10 msec to 100 msec. The reason is that the abnormal discharge is to be stopped perfectly.

At a step S136, then, the charging voltage applying circuit 62 is controlled to produce the charging voltage Vcg to be a set voltage (which may be predetermined) again, thereby turning ON an application of the charging voltage Vcg to the charger 29. At this time, a value of the charging voltage Vcg is set to be equal to or smaller than a value of a charging voltage before the occurrence of the abnormal discharge. The reason is that the occurrence of the abnormal discharge is to be suppressed when the charging voltage Vcg is applied again.

At a step S137, subsequently, a standby is carried out for a time period, for example, approximately 100 msec. At a step S145, then, the CPU 61 determines whether the abnormal discharge occurs again when the charging voltage Vcg is applied after the charging voltage Vcg is turned OFF and then a standby time period passes. If the abnormal discharge does not occur again, processings after the step S150 are executed. If the abnormal discharge does not occur again, processings after a step S170 are executed.

In the second exemplary embodiment, when the abnormal discharge occurs, the generation of the charging voltage Vcg is once turned OFF so that the charging voltage Vcg having a value which is equal to or smaller than the charging voltage Vcg before the occurrence of the abnormal discharge is generated and applied to the charger 29 after a time period passes. According to the second exemplary embodiment, it is possible to reliably stop the abnormal discharge and to suppress a recurrence of the abnormal discharge. As a result, even when the abnormal discharge occurs during the image formation, it can provide more cases in which the recording sheet 3 is ejected. Therefore, an amount of consumption of unnecessary developer can be reduced more greatly.

<Third Exemplary Embodiment>

Figure 6:
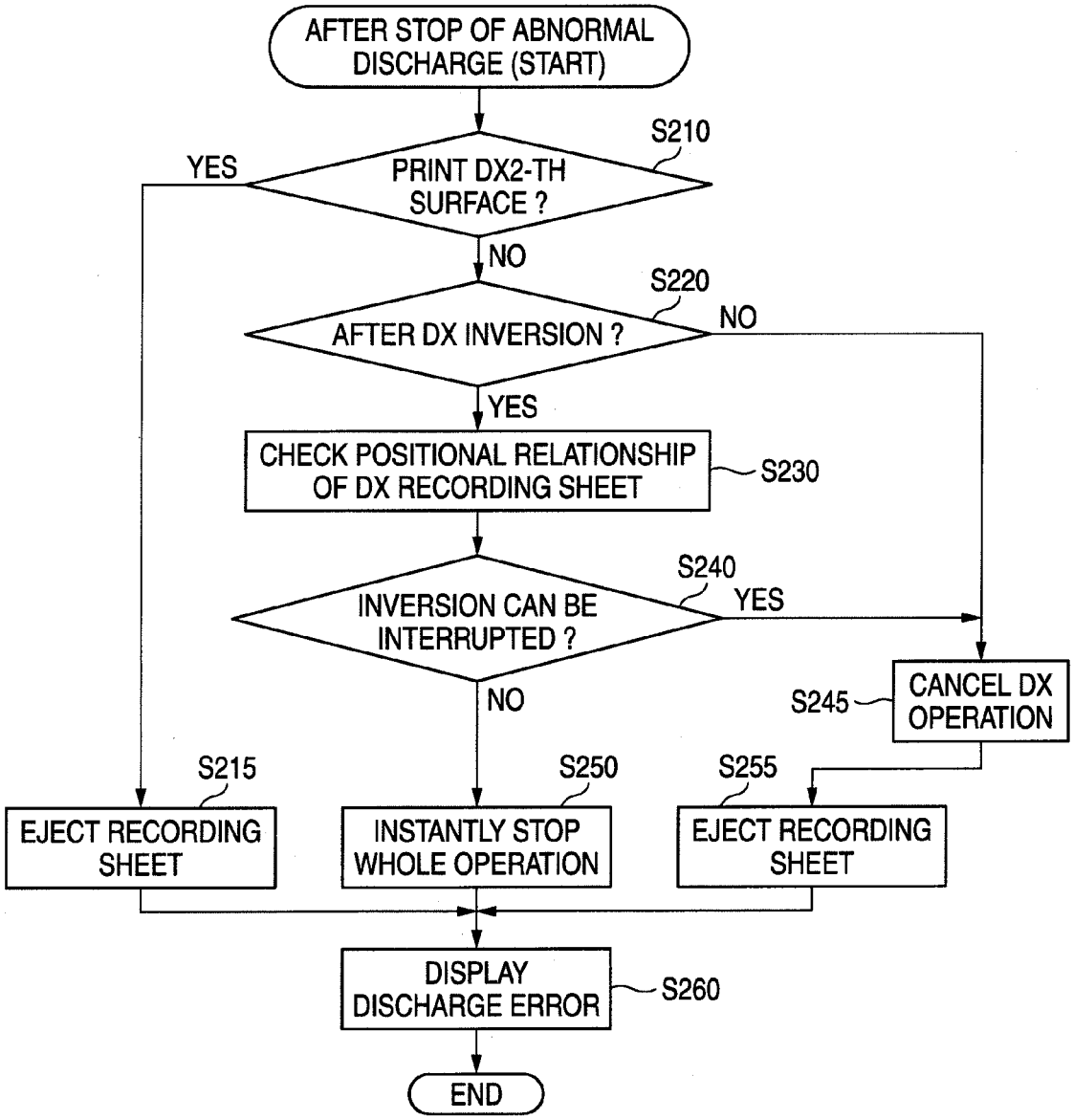
FIG. 6 is a flowchart showing a processing relating to a sheet ejection at an abnormal discharge during a duplex printing operation.

In a third exemplary embodiment, a processing relating to a sheet ejection in an abnormal discharge in case of Duplex (DX) printing will be described with reference to a flowchart of FIG. 6. The flowchart of FIG. 6 shows processings to be executed after the abnormal discharge is stopped. More specifically, the processings according to the third exemplary embodiment corresponds to the processings to be executed after it is determined that the abnormal discharge is stopped in the determination processing of the Step S140 in FIG. 3 in the first exemplary embodiment or the processings to be executed after it is determined that the abnormal discharge does not occur again in the determination processing of the step S145 of FIG. 5 in the second exemplary embodiment.

After the stop of the abnormal discharge, it is determined whether a second surface in a duplex print processing, that is, a back surface of a recording sheet 3 is being printed at a step S210. If the second surface is being printed, a processing for ejecting the recording sheet 3 is executed at a step S215 and a discharge error display is carried out at a step S260.

On the other hand, at the step S210, if it is determined that the second surface is not being printed, that is, a first surface (a front surface of the recording sheet 3) in the duplex print processing is being printed at the step S210, it is determined whether the conveyance of the recording sheet 3 has already been inverted for the duplex printing operation at a step S220. More specifically, for the duplex printing operation, it is determined whether a rotation of a ejection roller 45 has already been inverted in order to return the recording sheet 3 having a leading end ejected once to an outside of a laser printer 1. If the conveyance of the recording sheet 3 has not been inverted yet, a CPU 61 stops the duplex printing operation, that is, does not invert the rotation of the ejection roller 45 at a step S245 and ejects the recording sheet 3 to a output tray 46 at a step S255. Then, the discharge error display is carried out at the step S260.

On the other hand, if it is determined that the conveyance of the recording sheet 3 has already been inverted for the duplex printing at the step S220, a position of the leading end of the recording sheet 3 returned into the printer 1 by the inversion of the ejection roller 45 for the duplex printing operation (corresponding to the tail end 3*b* in FIG. 4 (which shows a state prior to the inversion of the recording sheet); and a leading end of the inverted recording sheet 3 will be hereinafter referred to as the "tail end 3*b*") is checked at a step S230. More specifically, when the occurrence of the abnormal discharge is stopped, it is determined a position of the tail end 3*b* of the recording sheet 3 in an inversion conveying unit 47. The checking operation is carried out for the following reason. When the tail end 3*b* of the recording sheet 3 returned into the printer 1 has not reached a first inversion conveying roller 50*a* at a time (timing) when the occurrence of the abnormal discharge is determined to be stopped, it is possible to eject the recording sheet 3 by further inverting the ejection roller 45, that is, normally rotating the ejection roller 45. In contrast, when the tail end 3*b* of the recording sheet 3 returned into the printer 1 has already reached the first inversion conveying roller 50*a*, the recording sheet 3 cannot be ejected because the first inversion conveying roller 50*a* blocks the operation even if the ejection roller 45 is normally rotated to eject the recording sheet 3.

At a step S240, it is determined whether the inversion of the ejection roller 45 can be interrupted to carry out a normal rotation, that is, whether the tail end 3*b* of the recording sheet 3 returned into the printer 1 has not reached the first inversion conveying roller 50*a* at a time that it is determined that the occurrence of the abnormal discharge is stopped. If it is determined that the tail end 3*b* of the recording sheet 3 has already reached the first inversion conveying roller 50*a*, it is impossible to interrupt the inversion of the ejection roller 45 so as to carry out the normal rotation. For this reason, the operation of the printer 1 is stopped at a step S250 and the discharge error display is carried out at the step S260.

On the other hand, if it is determined that the tail end 3*b* of the recording sheet 3 has not reached the first inversion conveying roller 50*a* at the step S240, it is possible to interrupt the inversion of the ejection roller 45. At the step S245, the duplex printing operation is cancelled, that is, the inverting operation of the ejection roller 45 is interrupted in this case. Then, the ejection roller 45 is normally rotated to eject the recording sheet 3 at the step S255 and the discharge error display is carried out at the step S260.

A distance from an ejection sensor 51 configured to detect the tail end 3*b* of the recording sheet 3 to the ejection roller 45, a timing for causing the ejection roller 45 to carry out an inverting operation for the duplex printing operation, a speed of the recording sheet 3 conveyed by means of the ejection roller 45 and a distance from the ejection roller 45 to the first inversion conveying roller 50*a* are predetermined values. Therefore, the CPU 61 can recognize a timing in which the tail end 3*b* of the recording sheet 3 reaches the first inversion conveying roller 50*a* based thereon. Therefore, in a timing in which the abnormal discharge is stopped after the inverting operation of the ejection roller 45, it is possible to determine that the tail end 3*b* of the recording sheet 3 reaches the first inversion conveying roller 50*a*.

Accordingly, even when the duplex printing operation is to be carried out, the CPU 61 controls the ejection roller 45 to further invert the inverting operation of the ejection roller 45 and to eject the recording sheet 3 during an image formation if it is determined that the occurrence of the abnormal discharge is stopped prior to a predetermined timing but after the ejection roller 45 is controlled to carry out the inverting operation. In this case, the predetermined timing implies a timing in which the tail end 3*b* of the recording sheet 3 returned by the inverting operation of the ejection roller 45 reaches the first inversion conveying roller 50*a*.

Therefore, even in the printer 1 for carrying out the duplex printing operation, it is possible to suitably eject the recording sheet 3 without causing a large amount of an intended developer to adhere to the recording sheet 3 before or after the inversion of the recording sheet 3 in the case in which the abnormal discharge occurs during the image formation. Since the inversion, particularly, the recording sheet 3 can be ejected if it is determined that the abnormal discharge is stopped before the timing in which the tail end 3*b* of the recording sheet 3 returned by the inverting operation of the ejection roller 45 reaches the first inversion conveying roller 50*a* after the ejection roller 45 is controlled to carry out the inverting operation.

<Modification of Exemplary Embodiments>

The invention is not limited to the exemplary embodiments explained with reference to the description and the drawings but the following modification of exemplary embodiments may be also included in the technical scope of the invention, for example.

(1) In the first exemplary embodiment, if it is determined that the abnormal discharge occurs, the CPU 61 may control the charging voltage applying circuit 62 to reduce the value of the charging voltage Vcg stepwise. For example, in order to perform the stepwise operation, a plurality (a given number) of sets of the steps S120, S130 and S140 may be performed as long as the result of the step S140 is "Yes." In other words, the processing shown in FIG. 3 may further include one or more sets of operations between the step S140 (Yes) and the step S150, each set of operations including: (a) reducing the charging voltage Vcg (e.g., changing the charging voltage from a current voltage level V1 to a voltage level V2 where V1>V2) similar to the step S120; (b) performing a standby for a given time period similar to the step S130; (c) determining whether the abnormal discharge still occurs similar to the step S140. If the result of the step (c) prior to an n-th set of operations is "Yes," the process proceeds to the step (a). If the result of the step (c) at the n-th set of operations is "Yes," the process proceeds to the step S150. If the result of the step (c) is "No," the process proceeds to the step S170.

According to this exemplary embodiment, by reducing the value of the charging voltage Vcg stepwise, it is possible to stop the abnormal discharge with the value of the charging voltage Vcg which is as close to that in a normal state as possible. Therefore, it is possible to reliably reduce an amount of consumption of the developer when the abnormal discharge occurs during the image formation and the recording sheet 3 is ejected.

(2) In the first exemplary embodiment or the Modification (1), it is also possible to reduce the value of the charging current Icg or to reduce the value of the charging current Icg stepwise based on the charging current detecting signal Si in place of the reduction in the value of the charging voltage Vcg or the stepwise reduction in the value of the charging voltage Vcg. In that case, referring to the value of the charging current Icg, 267 μA before the occurrence of the abnormal discharge is reduced to set 200 μA, for example. In this case, the charging current Icg is usually changed depending on a variation in the charging voltage Vcg. Therefore, it is possible to obtain the same advantages as those produced by changing the charging voltage Vcg.

(3) In the first exemplary embodiment or the second exemplary embodiment, it is also possible to omit the processings of the steps S150, S155 and S160. More specifically, if abnormal discharge is not stopped, the ejection of the recording sheet may not be performed.

According to a first aspect the exemplary embodiments of the invention, an image forming apparatus includes: a photoconductor; a charging unit configured to generate a discharge so as to charge the photoconductor; an applying unit configured to produce a charging voltage for generating the discharge and apply the charging voltage to the charging unit; a current detecting unit configured to detect a charging current flowing by applying the charging voltage to the charging unit and create a current detecting signal; an image forming unit configured to form an image on a recording medium by using a developer image carried on the photoconductor which is charged; a conveying unit configured to convey the recording medium on which the image is formed; and a control unit. The control unit is operable to: receive the current detecting signal; determine whether an abnormal discharge occurs during an image forming operation based on the current detecting signal; control the applying unit to reduce a value of the charging voltage if it is determined that the abnormal discharge occurs; determine whether the abnormal discharge stops by reducing the value of the charging voltage; and control the conveying unit to eject the recording medium during the image formation operation if it is determined that the abnormal discharge is stopped.

When the development is continuously performed in a state in which the abnormal discharge occurs, usually, an excessively large amount of the developer is used due to a decrease in the charging amount of the surface of the photoconductor. According to this aspect, when the value of the charging voltage is reduced, and thereby the occurrence of the abnormal discharge is stopped, the recording medium is ejected during the image forming operation. As a result, even when the abnormal discharge occurs during the image forming operation, it is possible to suppress the waste of the developer and to reduce a time and labor for removing the recording medium remaining in the apparatus. Thus, it is possible to relieve the countermeasure in the case in which the abnormal discharge occurs.

In a second aspect of the exemplary embodiments of the invention, there is provided an image forming apparatus according to the first aspect, wherein the control unit controls the applying unit to reduce the value of the charging voltage stepwise if it is determined that the abnormal discharge occurs.

According to this aspect, by stepwise reducing the value of the charging voltage, it is possible to stop the abnormal discharge with the value of the charging voltage which is as close to a value in a normal state as possible. Therefore, it is possible to reliably reduce an amount of consumption of the developer when the abnormal discharge occurs during the image forming operation and the recording medium is ejected.

In a third aspect of the exemplary embodiments of the invention, there is provided an image forming apparatus according to the first aspect, wherein the control unit is operable to: control the applying unit to turn OFF a production of the charging voltage if it is determined that the abnormal discharge occurs; and apply the charging voltage a first value to the charging unit after a time period elapses from a determination of occurrence of the abnormal discharge. The first value is equal to or smaller than a second value of the charging voltage prior to the occurrence of the abnormal discharge.

According to this aspect, the abnormal discharge can be stopped reliably, and furthermore, the abnormal discharge can be prevented from occurring again. Therefore, it is possible to reliably reduce an amount of consumption of the developer even when the abnormal discharge occurs during the image forming operation and ejection of the recording medium.

In a fourth aspect of the exemplary embodiments of the invention, there is provided an image forming apparatus according to any of the first to third aspects, wherein the control unit is operable to: turn OFF the production of the charging voltage when the abnormal discharge is not stopped by reducing the value of the charging voltage; and eject the recording medium during the image forming operation when the recording medium is located at a position in which a length from an image forming position to a tail end of the recording medium is equal to or smaller than a length on a circumference of the photoconductor in a rotating direction from a position opposing the charging unit to the image forming position.

According to this aspect, even when the abnormal discharge is not stopped by a countermeasure for reducing the value of the charging voltage, it is possible to suitably eject the recording medium during the image forming operation without causing a large amount of a non-intended developer to adhere to the recording medium.

In a fifth aspect of the exemplary embodiments of the invention, there is provided an image forming apparatus according to any of the first to fourth aspects, wherein the conveying unit is configured to perform an inverting operation to return the recording medium ejected once in order to form images on both sides of the recording medium, and the control unit is operable to control the conveying unit to eject the recording medium during the image forming operation without performing the inverting operation if it is determined that the abnormal discharge is stopped before controlling the conveying unit to perform the inverting operation.

According to this aspect, even in the image forming apparatus for carrying out Duplex (double-side) printing, when the abnormal discharge occurs, it is possible to suitably eject the recording medium during the image forming operation without causing a large amount of a non-intended developer to adhere to the recording medium. In that case, it is possible to eject the recording medium without performing the inverting operation.

In a sixth aspect of the exemplary embodiments of the invention, there is provided an image forming apparatus according to any of the first to fourth aspects, wherein the conveying unit is configured to perform an inverting operation to return the recording medium ejected once in order to form images on both sides of the recording medium, and the control unit controls the conveying unit to further invert the inverting operation of the conveying unit so as to eject the recording medium during the image forming operation if it is determined that the abnormal discharge is stopped prior to a predetermined timing after the conveying unit is controlled to perform the inverting operation.

According to this aspect, even in the image forming apparatus for carrying out the Duplex (double-side) printing, when the abnormal discharge occurs, it is possible to suitably eject the recording medium during the image formation without causing an unintended adhesion of a large amount of developer to the recording medium. In that case, it is possible to eject the recording medium after the inverting operation and prior to a predetermined timing.

in a seventh aspect of the exemplary embodiments of the invention, there is provided an image forming apparatus according to the sixth aspect, wherein the conveying unit comprises an inversion conveying roller configured to further conveying the recording medium returned by the inverting operation of the conveying unit, and the predetermined timing is a timing at which a leading end of the recording medium returned by the inverting operation reaches the inversion conveying roller.

According to this aspect, when it is determined that the occurrence of the abnormal discharge is stopped, it is possible to suitably eject the recording medium if the determination is made before a leading end of the recording medium reaches the inversion conveying roller, that is, before the leading end of the recording medium is conveyed by the inversion conveying roller so that the recording sheet cannot be ejected. "The leading end of the recording medium" is the leading end of the recording medium conveyed in an inverted direction in order to perform the duplex printing.

According to the image forming apparatus of the exemplary embodiments of the invention, even when the abnormal discharge occurs during the image forming operation, it is possible to suppress the waste of the developer and to relieve a countermeasure thereof.

What is claimed is:

1. An image forming apparatus comprising:

a photoconductor;

a charging unit configured to generate a discharge so as to charge the photoconductor;

an applying unit configured to produce a charging voltage for generating the discharge and apply the charging voltage to the charging unit;

a current detecting unit configured to detect a charging current flowing by applying the charging voltage to the charging unit and create a current detecting signal;

an image forming unit configured to form an image on a recording medium by using a developer image carried on the photoconductor when the photoconductor is charged;

a conveying unit configured to convey the recording medium on which the image is formed; and a control unit operable to:

receive the current detecting signal;

determine whether an abnormal discharge occurs during an image forming operation based on the current detecting signal;

control the applying unit to reduce a value of the charging voltage if it is determined that the abnormal discharge occurs;

determine whether the abnormal discharge stops due to a reduction in the value of the charging voltage;

control the image forming unit to stop forming the image and control the conveying unit to eject the recording medium undergoing the image forming operation if it is determined that the abnormal discharge is stopped;

turn OFF a production of the charging voltage when the abnormal discharge is not stopped due to the reduction in the value of the charging voltage; and eject the recording medium when the recording medium is located at a position in which a length from an image forming position, where the image is formed on the recording medium, to a tail end of the recording medium is equal to or smaller than a length on a circumference of the photoconductor in a rotating direction from a position opposing the charging unit to the image forming position.

* * * * *